United States Patent [19]

Penrod

[11] Patent Number: 4,757,641

[45] Date of Patent: Jul. 19, 1988

[54] DECORATIVE DEVICE FOR CAMOUFLAGING A WELL CASING

[75] Inventor: Bernice B. Penrod, Tipp City, Ohio

[73] Assignee: Dayton Precision Mfg. Co., Dayton, Ohio

[21] Appl. No.: 72,374

[22] Filed: Jul. 13, 1987

[51] Int. Cl.[4] ..... A47G 29/00; F41H 3/00

[52] U.S. Cl. ..... 47/39; 248/27.8; 248/315; 428/23; 428/919

[58] Field of Search ..... 428/17, 18, 19, 20, 428/919, 15, 23; 47/39; 248/27.8, 315

[56] References Cited

U.S. PATENT DOCUMENTS

| | | | |
|---|---|---|---|
| 1,112,558 | 10/1914 | Red | 47/39 X |
| 3,015,024 | 12/1961 | Charchan et al. | 47/39 X |
| 3,018,898 | 1/1962 | Frazelle | 47/39 X |
| 3,921,911 | 11/1975 | Sheets | 428/17 X |
| 4,083,457 | 4/1978 | Dromboski | 47/39 X |
| 4,291,075 | 9/1981 | Puleo | 428/20 X |
| 4,451,510 | 5/1984 | Boisvert et al. | 428/20 X |

FOREIGN PATENT DOCUMENTS

| | | | |
|---|---|---|---|
| 55055 | 4/1935 | Norway | 428/20 |
| 968489 | 9/1964 | United Kingdom | 47/49 |

*Primary Examiner*—Henry F. Epstein
*Attorney, Agent, or Firm*—Biebel, French & Nauman

[57] ABSTRACT

A decorative device for camouflaging a well casing which projects above the ground comprises a base place adapted to be secured on the upper end of the casing, a clamping assembly on top of the base plate, and a plurality of rod members secured in and projecting from the clamping assembly, the outer end of each of these rod members being configured to support a flower pot.

11 Claims, 2 Drawing Sheets

DECORATIVE DEVICE FOR CAMOUFLAGING A WELL CASING

BACKGROUND OF THE INVENTION

It is becoming increasingly common in the United States for a state or other local government to require that the casing for a well of the jet pump and pitless well adapter type should project above ground level to a sufficient height to reduce to a minimum the possibility that ground water can enter the casing and thus possibly contaminate the well. In many jurisdictions, the requirement is that the well casing project at least 12 inches above ground level, and it must of course also be provided with a suitable top cap protecting the interior of the well casing from the surrounding atmosphere.

Well casings of this type tend to be fairly large, since they must house the water supply pipe and pitless well adapter, and a common inner diameter is 6 inches so that the cap will have an outer diameter of 7 inches or more. As a result, each home having such a well is required to have an obstruction near the house, and frequently on the front lawn, which is roughly comparable in size and shape to a fire hydrant.

The present inventor has observed that in spite of the fact that this "eyesore" is required by law to protect the householders against well contamination, many cut it off as soon as possible after the installation has passed inspected. Unless enough of the casing is retained above ground, therefore, the well will be in danger of contamination from ground water, such as the run-off from a heavy rain storm or from melted snow.

SUMMARY OF THE INVENTION

The primary purpose of the present invention is to provide a decorative device for camouflaging that portion of a pitless well adapter well casing which is required by law or code to project above the ground. More specifically, the invention provides such a device in the form of a base plate adapted to be securely mounted on top of the well casing, and a plurality of rods which are clamped to this base plate by a top cover and project radially outwardly therefrom to receive and support flower pots or similar decorative items. In other words, the basic purpose of the invention is to convert the relatively unsightly upwardly projecting well casing into a decorative showpiece.

Other objects and advantages of the invention will be apparent from the following description, the accompanying drawings and the appended claims.

DESCRIPTION OF THE PREFERRED EMBODIMENT

Figure 2:
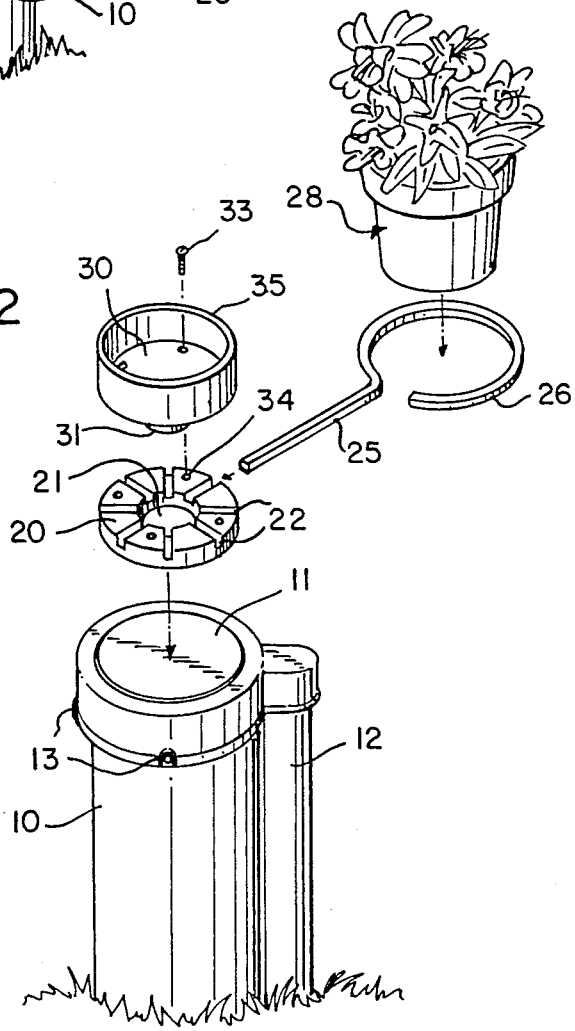
FIG. 2 is a perspective exploded view showing the major components of the device of the invention and the manner in which they are mounted in place.
Figure 3:
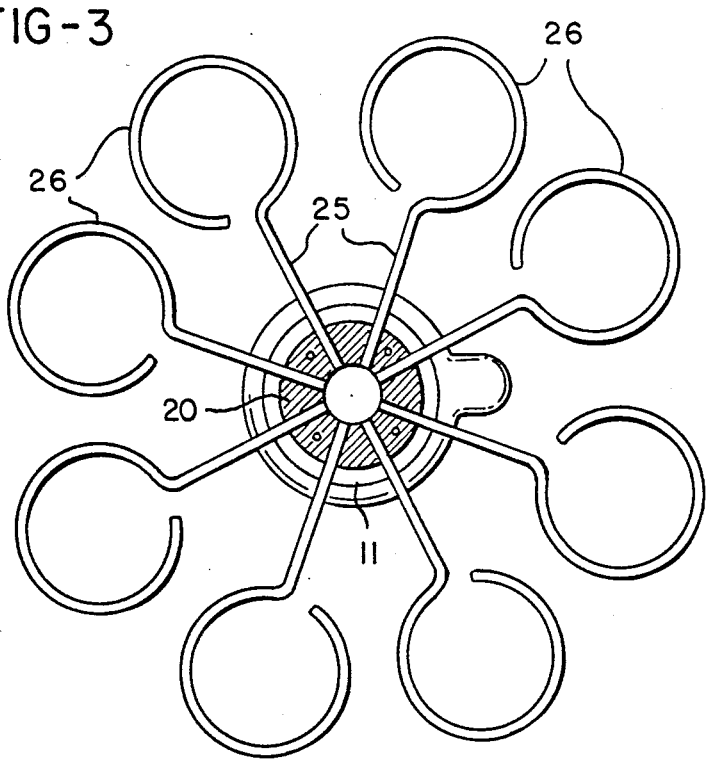
FIG. 3 is a plan view further illustrating the device of the invention.

Referring first to FIG. 2, the upper end of a typical casing 10 enclosing a pitless well adapter installation is shown as projecting a foot or more above ground level and provided with a top cap 11 for preventing access by falling or blown rain into the casing. Commonly, the casing 10 is made of PVC and includes an integral extension 12 along one side which houses the electrical cable connecting the jet pump at the bottom of the well casing with the electrical system inside the house. The top cap 11 is commonly of cast aluminum, and it fits over and is secured to the top of casing 10 by set screws 13.

The device of the invention includes a base plate 20, which may also be of cast aluminum, which is secured on top of the top cap 11 by any suitable means, satisfactory results having been obtained if the base plate 20 is held in place by epoxy cement. The base plate 20 is annular, with cylindrical inner and outer peripheries, to provide a central cylindrical opening 21. In addition, the upper surface of the base plate 20 is provided with equally spaced right-angled grooves 22, of predetermined depth as described below, which radiate from the opening 21.

Each of the grooves 22 is intended to receive the inner end of a rod member 25 of square section, and the grooves 22 preferably have a vertical dimension which is slightly less than the corresponding dimension of each rod 25 so that when the end of a rod 25 is inserted in the groove 22, the side of the rod will project slightly above the top of the groove. The opposite end 26 of each rod member 25 is curved to a circular hook configuration dimensioned to receive and support a conventional shouldered flower pot 28, as shown in FIGS. 1 and 4.

The device of the invention is completed by a cap member 30, which may also be of cast aluminum, and which includes a centrally located cylindrical boss 31 on its underside that is dimensioned to fit smoothly into the recess 21 in base plate 20. A series of screws 33 fit through holes in the bottom of cap member 30 and are threaded into tapped holes 34 in the base plate 20. When these screws are tightened in place, the cap member 30 firmly clamps the inner ends of the rod members 25 in the slots 22, as illustrated in FIG. 4, and the square shape of the rods prevents them from turning.

Figure 1:
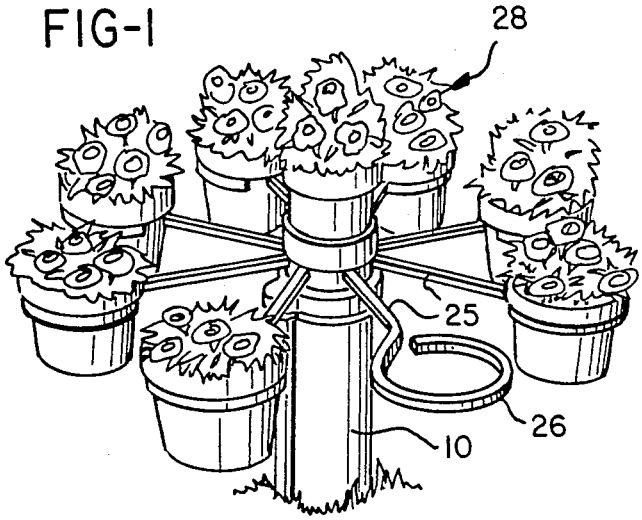
FIG. 1 is a perspective view showing a complete decorative device in accordance with the invention mounted on the top of a well casing.
Figure 4:
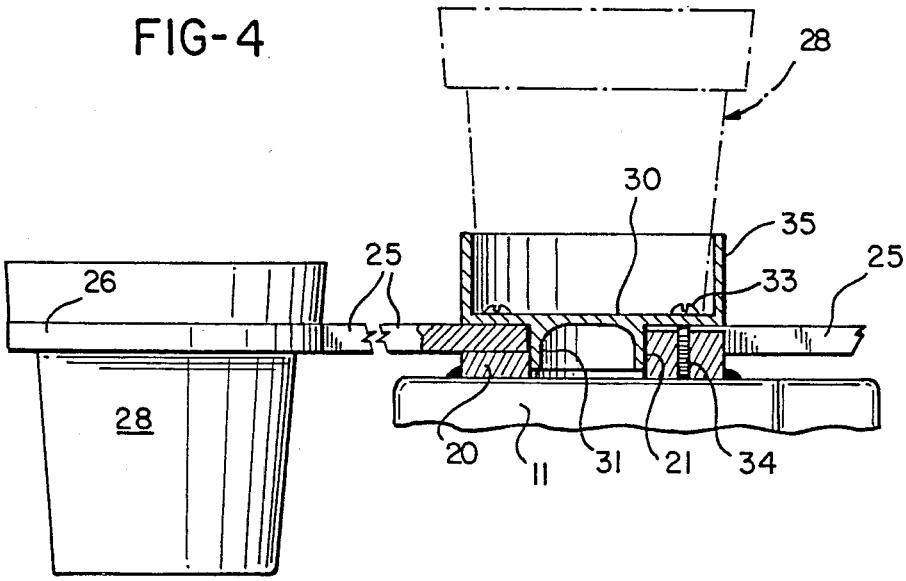
FIG. 4 is a section of the completed installation, taken as indicated by the line 4—4 of FIG. 3.

The cap member 30 is also shown as provided on its upper side with an annular rim 35 proportioned to define a bowl-like recess for receiving and retaining the bottom of an additional flower pot, as shown in FIG. 1 and in dotted lines in FIG. 4. Thus with flower pots mounted in the ring portion of each rod member 25 and in the bowl 35, the well casing and its top cap are converted from an eyesore into a decorative assembly which effectively camouflages the well casing, particularly when the pots are so proportioned, as shown, that the major portions of the flower pots overhang and conceal the casing.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A decorative device for camouflaging a well casing which projects above the ground, comprising:

(a) a base plate adapted to be secured on the upper end of said casing, (b) said base plate having in the upper surface thereof a plurality of slots radiating from the center thereof, (c) a plurality of rod members each having an inner end proportioned to fit in one of said slots and an outer end configured to support a flower pot or the like, and (d) means for clamping said rod members in said slots comprising a cap member and means for securing said cap member in clamping relation with said base plate with respect to said rod members.

2. A decorative device as defined in claim 1 wherein said inner ends of said rod members are of rectangular section, and said slots are right angled and slightly less deep than the height of said rectangular rod member ends whereby said cap member rests on and clamps said rod member ends in said slots.

3. A decorative device as defined in claim 1 wherein said cap member includes a bowl-like upper portion for receiving and supporting a flower pot.

4. A decorative device as defined in claim 2 wherein said base plate is provided with a recess in the center thereof, and said cap member includes a boss on the bottom thereof proportioned to fit within said recess to center said cap member with respect to said base plate.

5. A decorative device as defined in claim 4 wherein the inner ends of said slots open into said recess, and said boss on said cap member forms a stop for positioning the inner ends of said rod members in said slots.

6. A decorative device for camouflaging a well casing which projects above the ground, comprising:

(a) a cylindrical base plate adapted to be secured on the upper end of said casing, (b) said base plate having in the upper surface thereof a centrally located recess and a plurality of slots radiating from said recess to the outer periphery of said base plate, (c) a plurality of rod members each having an inner end proportioned to fit in one of said slots and an outer end configured to support a flower pot or the like, (d) said inner ends of said rod members being of rectangular section, and said slots being right angled and slightly less deep than said rod member ends whereby said rod member project above said slots, (e) a cap member including a boss proportioned to fit within said recess in said base plate, and (f) bolt means for securing said cap member to said base plate in clamping relation with said inner ends of said rod members.

7. A decorative device as defined in claim 6 wherein said cap member includes a bowl-like upper portion for receiving and supporting a flower pot.

8. The combination comprising:

(a) a well casing which projects above the ground level and has a cap on the upper end thereof, (b) a base plate secured on said cap, and (c) a plurality of rod members each having an inner end secured to said base plate and an outer end configured to support a flower pot or the like.

9. The combination defined in claim 8 wherein said base plate has in the upper surface thereof a plurality of slots radiating from the center thereof, said inner end of each of said rod members being proportioned to fit in one of said slots, and further comprising a cap member secured on top of said base plate in clamping relation with said base plate with respect to said rod members.

10. The combination defined in claim 9 wherein said inner ends of said rod members are of rectangular section, and said slots are right angled and slightly less deep than the height of said rectangular rod member ends whereby said cap member rests on and clamps said rod member ends in said slots.

11. The combination defined in claim 10 wherein said base plate is provided with a recess in the center thereof, said cap member includes a boss on the bottom thereof proportioned to fit within said recess to center said cap member with respect to said base plate, the inner ends of said slots open into said recess, and said boss on said cap member forms a stop for positioning the inner ends of said rod members in said slots.

* * * * *